US009776832B2

(12) United States Patent
Witczak et al.

(10) Patent No.: US 9,776,832 B2
(45) Date of Patent: Oct. 3, 2017

(54) SELF-PROPELLED CARGO LIFT FOR ELEVATOR SYSTEMS

(71) Applicant: OTIS ELEVATOR COMPANY, Farmington, CT (US)

(72) Inventors: Tadeusz Pawel Witczak, Bethel, CT (US); Richard N. Fargo, Plainville, CT (US); Martin J. Hardesty, West Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 14/765,928

(22) PCT Filed: Feb. 6, 2013

(86) PCT No.: PCT/US2013/024803

§ 371 (c)(1),
(2) Date: Aug. 5, 2015

(87) PCT Pub. No.: WO2014/123515

PCT Pub. Date: Aug. 14, 2014

(65) Prior Publication Data

US 2015/0368071 A1 Dec. 24, 2015

(51) Int. Cl.

| | |
|---|---|
| ***B66B 11/04*** | (2006.01) |
| ***B66B 9/02*** | (2006.01) |
| ***B66B 19/00*** | (2006.01) |

(52) U.S. Cl.

CPC ..... *B66B 11/0492* (2013.01); *B66B 9/02* (2013.01); *B66B 11/0407* (2013.01);
(Continued)

(58) Field of Classification Search

CPC ... B66B 11/0492; B66B 11/0407; B66B 9/02; B66B 19/00; B66B 19/005; B66B 2201/307
(Continued)

(56) References Cited

U.S. PATENT DOCUMENTS 1,392,078 A * 9/1921 Ouillett ..... B66B 9/02 187/271
3,814,962 A * 6/1974 Baermann ..... H02K 49/102 310/103
(Continued)

FOREIGN PATENT DOCUMENTS

CN 101903278 A 12/2010
CN 102574478 A 7/2012
(Continued)

OTHER PUBLICATIONS

Donoghue, Edward A., "ASME A17.1 CSA B44 Handbook" 2007 Edition, American Society of Mechanical Engineers, p. 134.
(Continued)

*Primary Examiner* — Michael Riegelman
(74) *Attorney, Agent, or Firm* — Cantor Colburn LLP

(57) ABSTRACT

An elevator system includes a car, configured to travel through a hoistway; a first stationary drive unit, configured to be mounted in a hoistway, a first movable drive unit, configured to be functionally coupled to the car and to the first stationary drive unit, and a second movable drive unit, configured to be functionally coupled to the car and to the first stationary drive unit.

8 Claims, 6 Drawing Sheets

(52) U.S. Cl.
CPC ..... *B66B 19/00* (2013.01); *B66B 19/005* (2013.01); *B66B 2201/307* (2013.01)

(58) Field of Classification Search
USPC ..... 187/250
See application file for complete search history.

(56) References Cited

U.S. PATENT DOCUMENTS 5,158,156 A * 10/1992 Okuma ..... H02K 41/03 187/250
5,174,416 A * 12/1992 Sakabe ..... B66B 11/0407 104/292
5,183,980 A * 2/1993 Okuma ..... B66B 11/0407 187/250
5,288,956 A 2/1994 Kadokura et al.
5,907,136 A 5/1999 Hongo et al.
7,681,694 B2 * 3/2010 Aulanko ..... B66B 1/302 187/277
2002/0125075 A1 * 9/2002 Lin ..... B66B 9/025 187/267
2003/0000778 A1 * 1/2003 Smith ..... B66B 1/30 187/289
2003/0196857 A1 * 10/2003 Tiner ..... B66B 7/064 187/413
2004/0027020 A1 2/2004 Newcomb
2005/0056493 A1 * 3/2005 Molnar ..... B66B 9/025 187/271
2008/0093177 A1 * 4/2008 Fargo ..... B66B 7/068 187/249
2008/0223666 A1 * 9/2008 Cuthbert ..... B66B 11/0407 187/288
2011/0005867 A1 1/2011 Kocher
2012/0193172 A1 8/2012 Matscheko et al.
2013/0206514 A1 * 8/2013 Kim ..... B66B 9/025 187/240
2013/0306408 A1 * 11/2013 Jacobs ..... B66B 11/0095 187/249
2015/0191329 A1 * 7/2015 Moon ..... B66B 9/00 187/254
2015/0307325 A1 * 10/2015 Fargo ..... B66B 11/0438 187/250
2016/0083226 A1 * 3/2016 Piech ..... B66B 11/0407 187/250

FOREIGN PATENT DOCUMENTS

GB 2324170 A 10/1998
JP S6255904 A 3/1987
JP H06335229 A 12/1994
JP 2001294381 A 10/2001
JP 5286655 B2 9/2013

OTHER PUBLICATIONS

International Search Report for application PCT/US2013/024803, dated Nov. 7, 2013, 5 pages.
Written Opinion for application PCT/US2013/024803, dated Nov. 7, 2013 7 pages.
Chevailler S., et al., "Linear Motors for multi mobile systems", Conference Record of the 2005 IEEE Industry Conference 40th IAS Annual Meeting Oct. 2-6 2005, vol. 3, pp. 2099-2106.
Chinese Office action and search report for application CN 201380072452.4, dated Sep. 8, 2016, 7 pages.
European Search Report for application EP 13874746.4 dated Sep. 6, 2016, 8 pages.
European Office Action for application EP 13874746.4, dated May 2, 2017, 6 pgs.

* cited by examiner

SELF-PROPELLED CARGO LIFT FOR ELEVATOR SYSTEMS

FIELD OF INVENTION

The subject matter disclosed herein relates generally to the field of elevator systems, and more particularly, to a cargo lift for elevator systems.

BACKGROUND

Construction, maintenance and service of elevators often requires that components be lifted along the hoistway for installation. For example, during installation of an elevator system, the drive machine and/or power transformer needs to be lifted to the top of the hoistway for installation. Similar loads may also need to be lifted during maintenance activities over the life of a building. Existing construction techniques employ cranes to lift components up the hoistway. Cranes are expensive and require large amounts of space to operate. Elevator cars are also used for lifting one-piece loads, often referred to in the art as safe lifts.

BRIEF SUMMARY

According to an exemplary embodiment, an elevator system includes a car, configured to travel through a hoistway; a first stationary drive unit, configured to be mounted in a hoistway, a first movable drive unit, configured to be functionally coupled to the car and to the first stationary drive unit, and a second movable drive unit, configured to be functionally coupled to the car and to the first stationary drive unit.

According to another exemplary embodiment, a cargo lift for an elevator system, the cargo lift includes a car for travel in a hoistway; a first propulsion assembly, the first propulsion assembly including a first self-propelled drive unit, a stationary portion of the first self-propelled drive unit mounted in the hoistway and a moving portion of the first self-propelled drive unit mounted to the car; and a second propulsion assembly functionally coupled to the car, the second propulsion assembly including a second self-propelled drive unit, a moving portion of the second self-propelled drive unit functionally coupled to the car, the moving portion of the second self-propelled drive unit coacting with the stationary portion of the first self-propelled drive unit.

According to another exemplary embodiment, a method for providing a cargo lift in an elevator system includes configuring a car for cargo lift, the configuring including: obtaining a first propulsion assembly, the first propulsion assembly including a first self-propelled drive unit, a stationary portion of the first self-propelled drive unit mounted in a hoistway and a moving portion of the first self-propelled drive unit mounted to the car; functionally coupling a second propulsion assembly to the car, the second propulsion assembly including a second self-propelled drive unit, a moving portion of the second self-propelled drive unit functionally coupled to the car, the moving portion of the second self-propelled drive unit coacting with the stationary portion of the first self-propelled drive unit; operating the car as a cargo lift; and configuring the car for passenger service.

According to another exemplary embodiment, an elevator system includes a car, configured to travel through a hoistway; a first stationary drive unit, mounted in a hoistway; a second stationary drive unit, mounted in a hoistway; a first movable drive unit functionally coupled to the car and to the first stationary drive unit, and a second movable drive unit, functionally coupled to the car and to the first stationary drive unit; a third movable drive unit, unit, functionally coupled to the car and to the second stationary drive unit; and a fourth movable drive unit, functionally coupled to the car and to the second stationary drive unit.

Other aspects, features, and techniques of embodiments of the invention will become more apparent from the following description taken in conjunction with the drawings.

BRIEF DESCRIPTION OF THE DRAWINGS

Referring now to the drawings wherein like elements are numbered alike in the FIGURES.

DETAILED DESCRIPTION

Figure 1:
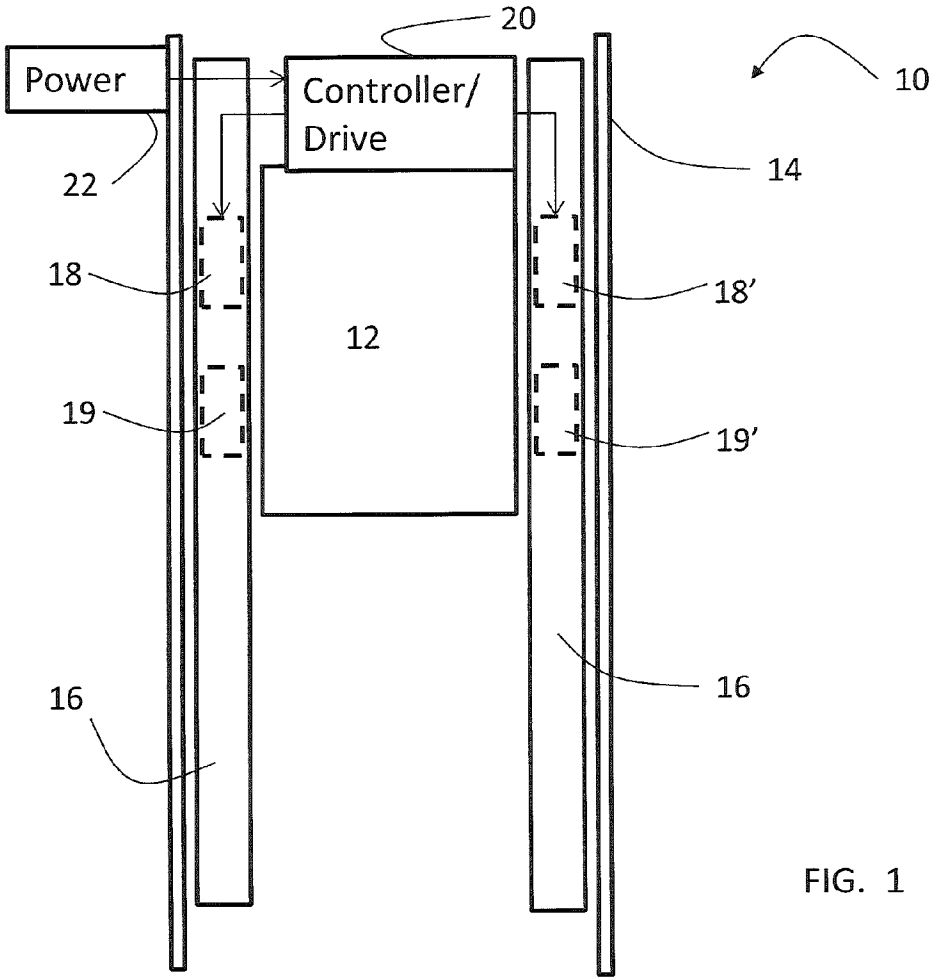
FIG. 1 depicts a self-propelled elevator cargo lift in an exemplary embodiment.

FIG. 1 depicts a cargo lift for an elevator system 10 in an exemplary embodiment. Elevator system 10 includes an elevator car 12 that travels in a hoistway 14. Guide rails 16 are positioned in the hoistway 14 and serve to guide elevator car 12 along the hoistway. Multiple propulsion assemblies are used with elevator car 12 to impart motion to elevator car 12. Shown in FIG. 1, a first propulsion assembly includes a pair of drive units 18-18' and a second propulsion assembly includes a pair of drive units 19-19'. Using multiple pairs of drive units 18-18' and 19-19' enhances the load carrying capacity of the car 12 to serve lifting demands during construction, maintenance and service. Although two propulsion assemblies are shown, it is understood that more than two propulsion assemblies may be used.

A controller 20 provides control signals to the propulsion assemblies to control motion of the car 12 (e.g., upwards or downwards) and to stop the car 12. Controller 20 may be implemented using a general-purpose microprocessor executing a computer program stored on a storage medium to perform the operations described herein. Alternatively, controller 20 may be implemented in hardware (e.g., ASIC, FPGA) or in a combination of hardware/software. Controller 20 may also be part of an elevator control system. Power source 22 provides power to drive units 18-18' and 19-19' under the control of controller 20. Power source 22 may be distributed along at least one rail in the hoistway 14 to power drive units 18-18' and 19-19' as car 12 travels. Alternatively, a power cable may be used to provide power to drive units 18-18' and 19-19'. It is understood that other control elements (e.g., speed sensors, position sensor, accelerometers) may be in communication with controller 20 for controlling motion of car 12.

Figure 2:
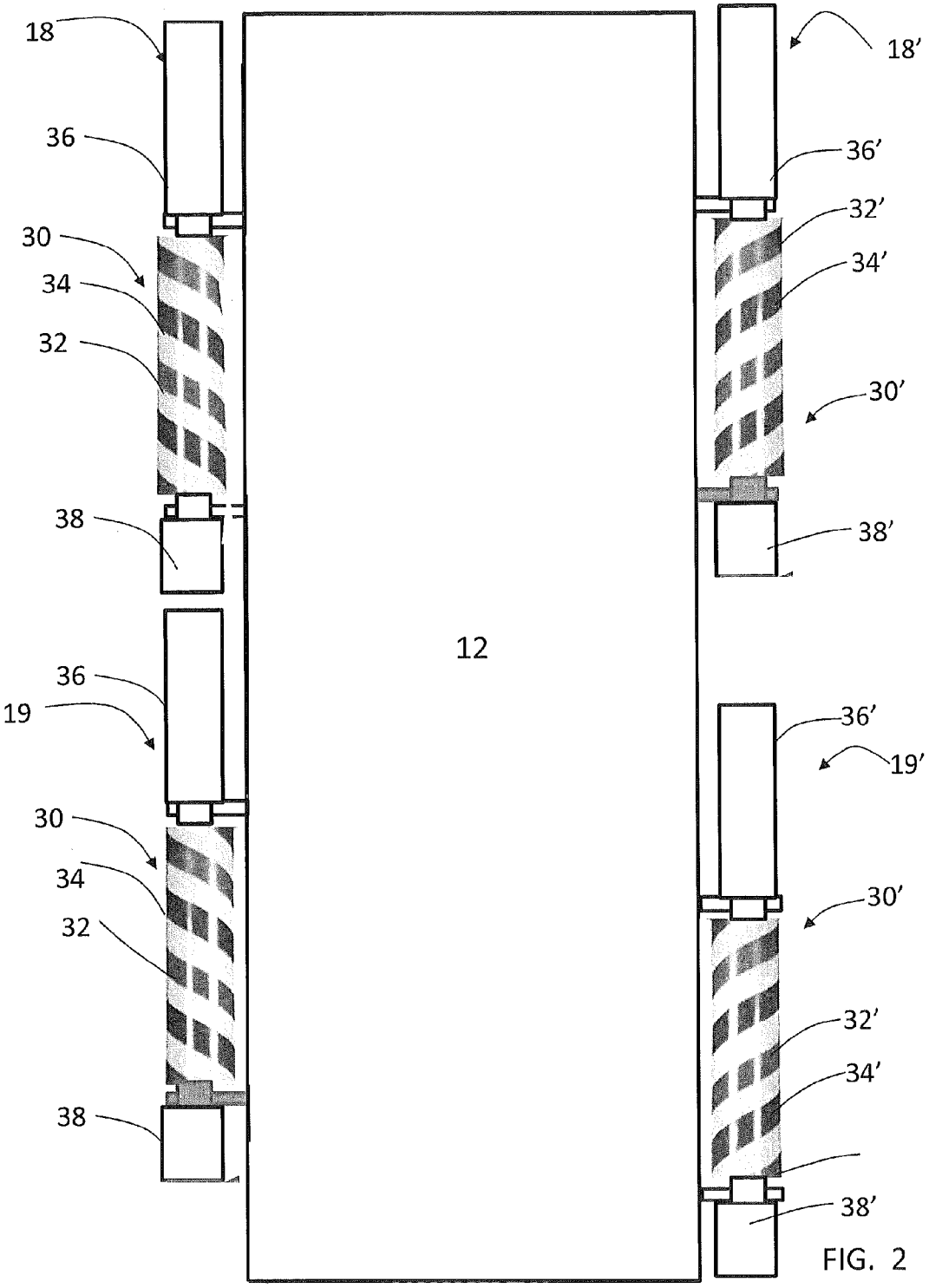
FIG. 2 depicts a self-propelled elevator cargo lift in an exemplary embodiment.

FIG. 2 depicts an elevator car 12 with a first propulsion assembly having a first pair of drive units 18-18' and second propulsion assembly having a second pair of drive units 19-19'. Drive unit 18 includes a first portion in the form of a magnetic screw 30 having a magnetic element in the form of first permanent magnet 32 of a first polarity positioned along a non-linear (e.g., helical) path along a longitudinal axis of the magnetic screw 30. The first portion (e.g., magnetic screw 30) is a moving portion, as it is connected to car 12 and travels with car 12. A second magnetic element in the form of a second permanent magnet 34 of a second polarity (opposite the first polarity) is positioned along a non-linear (e.g., helical) path along a longitudinal axis of the magnetic screw 30. The paths of the first permanent magnet 32 and second permanent magnet 34 do not intersect.

A motor 36 (e.g., a spindle motor) is positioned at a first end of the magnetic screw 30 and rotates the magnetic screw 30 about its longitudinal axis in response to control signals from controller 20. In an exemplary embodiment, the outer diameter of motor 36 is less than the outer diameter of magnetic screw 30 to allow the motor 36 to travel within a cavity in a stator. A brake 38 (e.g., a disk brake) is positioned at a second end of the magnetic screw 30 to apply a braking force in response to control signals from controller 20. In an exemplary embodiment, the outer diameter of brake 38 is less than the outer diameter of magnetic screw 30 to allow the brake 38 to travel within a cavity in a stator. In an exemplary embodiment, brake 38 may be a disk brake. Further, brake 38 may be part of motor 36 in a single assembly. Drive unit 18 is coupled to the car 12 through supports, such as rotary and/or thrust bearings, for example.

A drive unit 18' may be positioned on an opposite side of car 12 as drive unit 18. Components of the second drive unit 18' are similar to those in the first drive unit 18 and labeled with similar reference numerals. Magnetic screw 30' has a first permanent magnet 32' of a first polarity positioned along a non-linear (e.g., helical) path along a longitudinal axis of the magnetic screw 30'. A second permanent magnet 34' of a second polarity (opposite the first polarity) is positioned along a non-linear (e.g., helical) path along a longitudinal axis of the magnetic screw 30'.

The pitch direction of the helical path of the first permanent magnet 32' and the second permanent magnet 34' is opposite that of the helical path of the first permanent magnet 32 and the second permanent magnet 34. For example, the helical path of the first permanent magnet 32 and the second permanent magnet 34 may be counter clockwise whereas the helical path of the first permanent magnet 32' and the second permanent magnet 34' is clockwise. Further, motor 36' rotates in a direction opposite to the direction of motor 36. The opposite pitch and rotation direction of the magnetic screws 30 and 30' balances rotational inertia forces on car 12 during acceleration. FIG. 2 also depicts first portions of the second propulsion assembly having a second pair of drive units 19-19'. Drive units 19-19' are constructed in a manner similar to drive units 18-18' and similar elements are represented with similar reference numerals.

Figure 3:
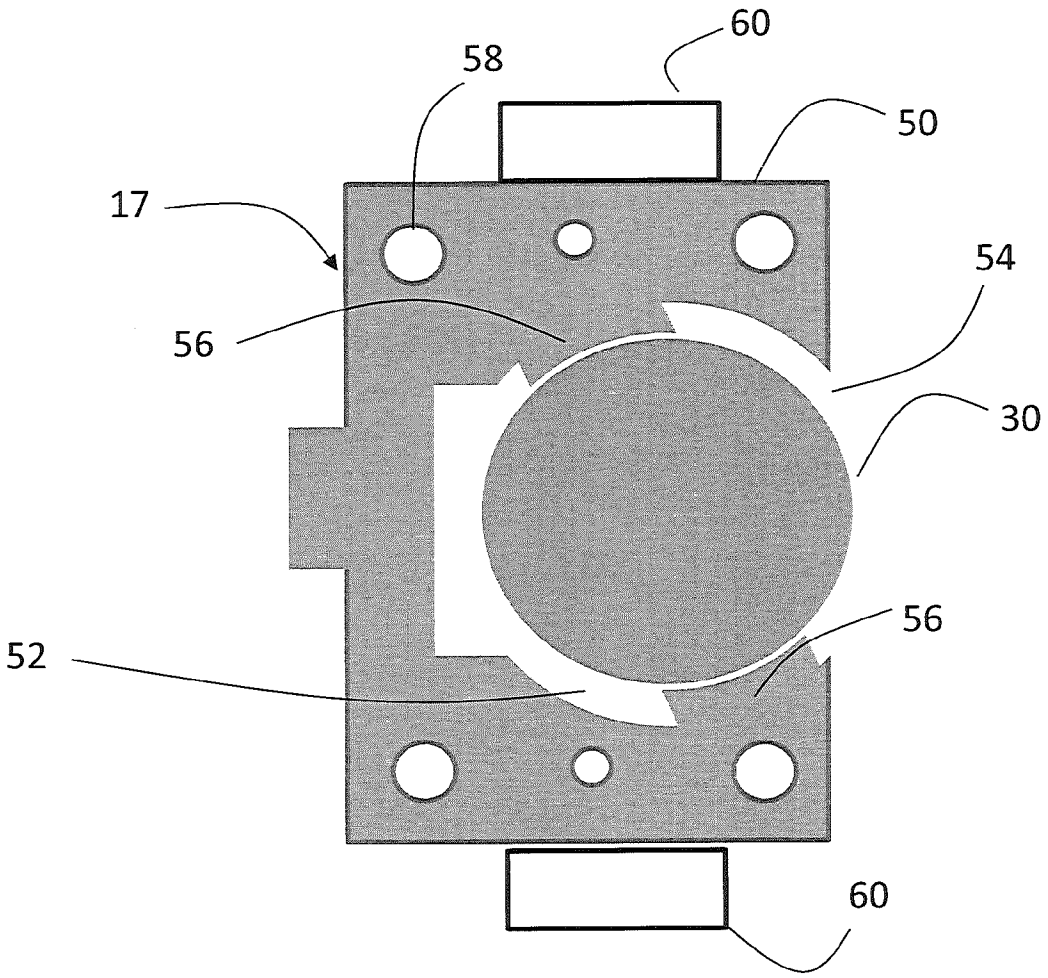
FIG. 3 is a top view of stator and magnetic screw in an exemplary embodiment.

FIG. 3 is a top view of a stator 17 and magnetic screw 30 in an exemplary embodiment. A similar stator may be positioned on each side of the hoistway. The stators 17 form a second, stationary portion of drive units 18, 18', 19 and 19', while magnetic screws 30 and 30' form a first, moving portion of the drive units 18, 18', 19 and 19'. Stator 17 may be formed as part of guide rail 16 or may be a separate element in the hoistway 14. Stator 17 has a body 50 of generally rectangular cross section having a generally a circular cavity 52 in an interior of body 50. Body 50 has an opening 54 leading to cavity 52. Poles 56 extend inwardly into cavity 52 to magnetically coact with magnetic screw 30 to impart motion to the magnetic screw 30 and car 12. The poles 56 preferably form a helical protrusion in the interior of the body 50.

Stator 17 may be formed using a variety of techniques. In one embodiment, stator 17 is made from a series of stacked plates of a ferrous material (e.g., steel or iron). In other embodiments, stator 17 may be formed from a corrugated metal pipe (e.g., steel or iron) having helical corrugations. The helical corrugations serve as the poles 56 on the interior of the pipe. An opening, similar to opening 54 in FIG. 3, may be machined in the pipe. In other embodiments, stator 16 may be formed by stamping poles 56 into a sheet of ferrous material (e.g., steel or iron) and then bending the sheet along its longitudinal axis to form stator 17.

When stator 17 is part of guide rail 16, the outer surfaces of body 50 may be smooth and provide a guide surface for one or more guide rollers 60. Guide rollers 60 may be coupled to the magnetic screw assembly 18 to center the magnetic screw 30 within stator 17. Centering the magnetic screw 30 in stator 17 maintains an airgap between the magnetic screw 30 and poles 56. A lubricant or other surface treatment may be applied to the outer surface of body 50 to promote smooth travel of the guide rollers 60.

Figure 4:
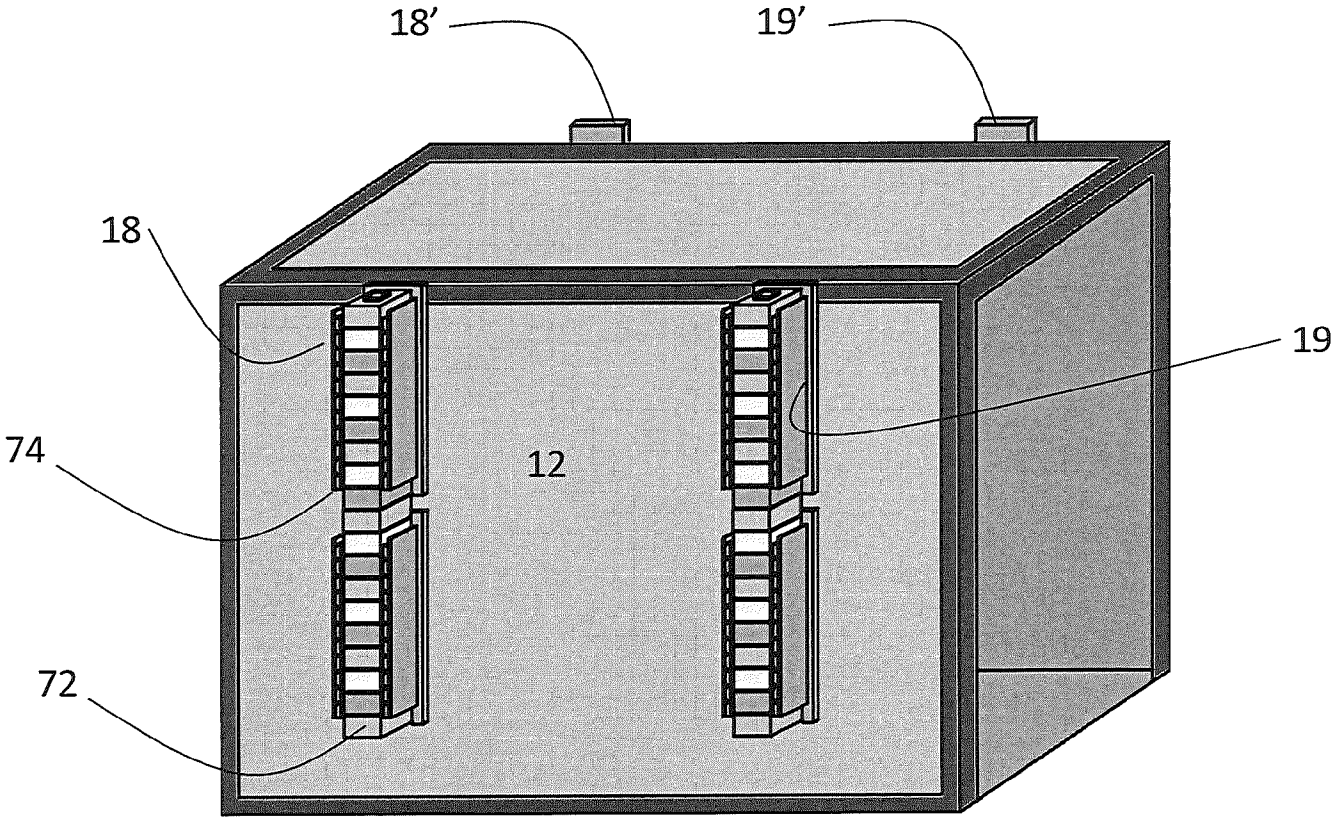
FIG. 4 depicts a self-propelled elevator cargo lift in an exemplary embodiment.

FIG. 4 depicts a self-propelled elevator cargo lift in an exemplary embodiment. The cargo lift includes a car 12 fitted with a first propulsion assembly and a second propulsion assembly. The first propulsion assembly includes a pair of drive units 18-18', on opposite sides of car 12, and a second propulsion assembly includes a pair of drive units 19-19', on opposite sides of car 12. In the embodiment of FIG. 4, the drive units 18, 18', 19 and 19' are implemented using linear motors. Permanent magnets 74 define a first, moving portion of drive units 18, 18', 19 and 19' connected to, and traveling with, the car 12. Stator windings 72 define a second, stationary portion of drive units 18, 18', 19 and 19' and may be formed on the guide rail 16 mounted in the hoistway 14. Control signals from controller 20 to the pair of drive units 18-18' and the pair of drive units 19-19' impart motion to car 12.

Figure 5:
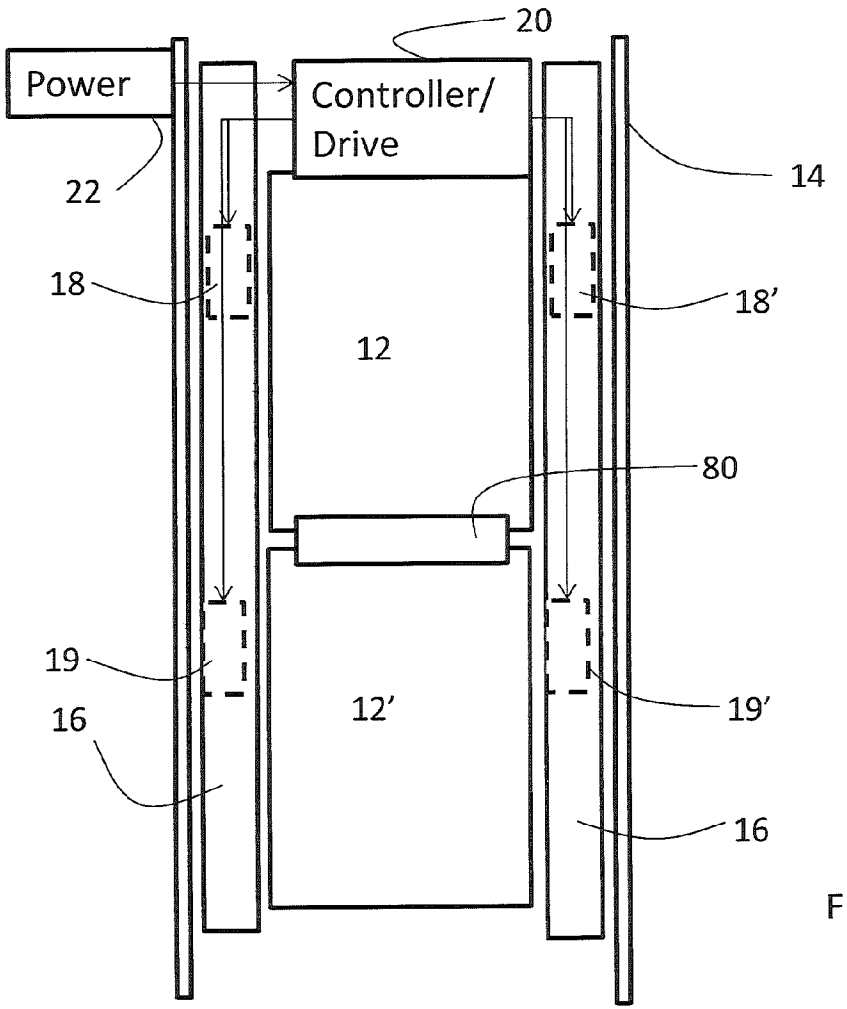
FIG. 5 depicts a self-propelled elevator cargo lift in an exemplary embodiment.

FIG. 5 depicts a self-propelled elevator cargo lift in an exemplary embodiment. In FIG. 5, a first car 12 includes a first propulsion assembly having drive units 18 and 18'. A second car 12' includes a second propulsion assembly having drive units 19 and 19'. First car 12 and second car 12' are joined by a coupler 80 that physically connects cars 12 and 12'. Control signals from controller 20 to the pair of drive units 18-18' and the pair of drive units 19-19' impart motion to cars 12 and 12'.

In the embodiments shown in FIGS. 2-5, each propulsion assembly includes a pair of drives units. It is understood that a single drive unit may be used in each propulsion assembly, as long as the propulsion assembly and guide system can handle moments caused by a system having a drive unit on a single side of the car. It is noted that the drive units 18, 18', 19 and 19' include two portions (e.g., moving and stationary) that coact to provide motion to the car 12. For example, in FIG. 4 a first, moving portion of drive unit 18 (i.e., permanent magnets 72) is coupled to the car 12 whereas a second, stationary portion of drive unit 18 (i.e., windings 72) is mounted in the hoistway. It is also noted that two drive units (e.g., 18 and 19) may share and coact with a common stationary portion (e.g., stator 17).

Figure 6:
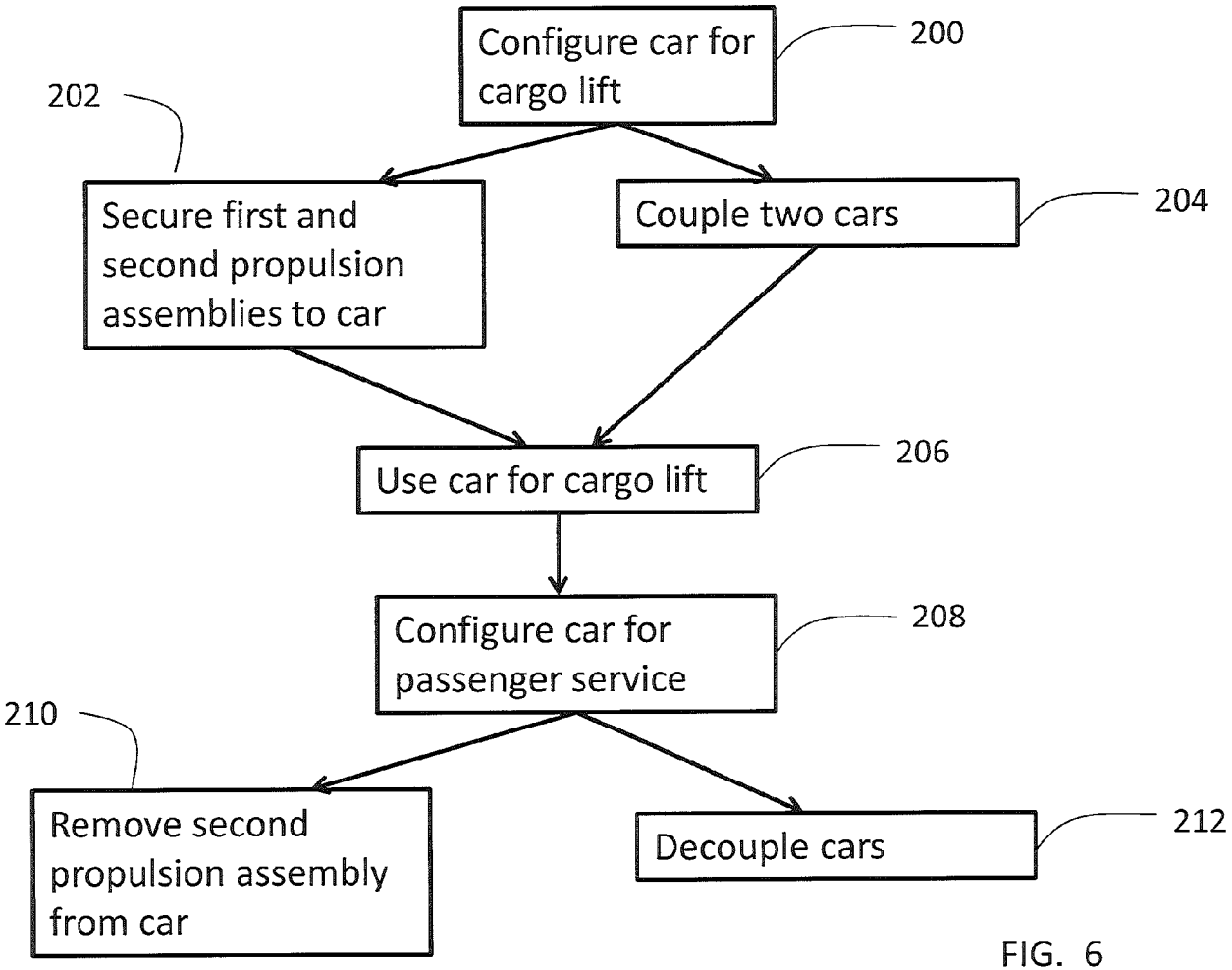
FIG. 6 depicts a method of configuring an elevator car for cargo lift operations in an exemplary embodiment.

FIG. 6 depicts a method of configuring an elevator car for cargo lift operations in an exemplary embodiment. The process begins at 200 where a car is configured for cargo lift operations. This may entail securing a first propulsion assembly and second propulsion assembly to a car at 202. Alternatively, this may entail coupling two cars to define a joined car, including a first car having a first propulsion assembly and a second car having a second propulsion assembly at 204. At 206, the car is used for cargo lift applications, such as lifting a drive machine or transformer to the top of the hoistway, of safe lift applications. It is understood that other cargo lift operations may be performed, including a variety of types of installation, maintenance and service. At 208, the car is reconfigured for passenger service. This may entail removing the second propulsion assembly at 210 or decoupling the cars forming the joined car at 212.

Embodiments enable cargo lift operations by increasing car load through a serial connection of self-propelling pairs of drive units. Embodiments can be used as a cargo lift for transporting roped machines, which eliminates the need of using heavy duty cranes. Any kind self-propelling drive units may be used.

Embodiments also provide a cargo lift earlier in the construction process. Once there is a minimal rail length installed in the hoistway, the system can be used to run and function as a working platform for all subsequent installation. There is no need to wait until the full rise and drive machine are in place to use the elevator. This allows other building construction trades to use the elevator(s) at a much earlier, lower rise stage.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as being limited by the foregoing description, but is only limited by the scope of the appended claims.

The invention claimed is:

1. An elevator system comprising:

a car, configured to travel through a hoistway;

a first stationary drive unit, configured to be mounted in the hoistway, a first movable drive unit mounted to the car and driven by the first stationary drive unit, a second car, configured to travel through the hoistway, a second movable drive unit mounted to the second car;

wherein the second car is physically connected to the car.

2. The elevator system of claim 1 further comprising:

a second stationary drive unit, configured to be mounted in the hoistway, and wherein the second movable drive unit is driven by the second stationary drive unit.

3. The elevator system of claim 2 further comprising, a third movable drive unit mounted to the car and a fourth movable drive unit mounted to the second car;

wherein the third movable drive unit is driven by the second stationary drive unit and the fourth movable drive unit is driven by the first stationary drive unit.

4. The elevator system of claim 1, further comprising:

a power source coupled to the car, the power source providing power for at least one of the first stationary drive unit, the first movable drive unit, or the second movable drive unit.

5. The elevator system of claim 1 wherein:

at least one of the first stationary drive unit or the first movable drive unit comprises a magnetic screw.

6. The elevator system of claim 1 wherein:

at least one of the first stationary drive unit or the first movable drive unit comprises a linear motor.

7. A method for providing a cargo lift in an elevator system, the method comprising:

configuring a car and a second car for cargo lift, the configuring including:

obtaining a first propulsion assembly, the first propulsion assembly including a first self-propelled drive unit, a stationary portion of the first self-propelled drive unit mounted in a hoistway and a moving portion of the first self-propelled drive unit mounted to the car;

obtaining a second propulsion assembly, the second propulsion assembly including a second self-propelled drive unit, a moving portion of the second self-propelled drive unit mounted to the second car;

physically connecting the car and the second car;

operating the car and the second car as a cargo lift; and configuring the car for passenger service by disconnecting the second car from the car.

8. An elevator system comprising:

a car, configured to travel through a hoistway;

a first stationary drive unit, mounted in the hoistway;

a second stationary drive unit, mounted in the hoistway;

a first movable drive unit functionally mounted to the car and driven by the first stationary drive unit, and a second movable drive unit, functionally mounted to the car and driven by the second stationary drive unit;

a second car physically connected to the car;

a third movable drive unit mounted to the second car and driven by the first stationary drive unit; and a fourth movable drive unit mounted to the second car and driven by the second stationary drive unit.

* * * * *